US007370996B2

(12) United States Patent
Ohshio

(10) Patent No.: US 7,370,996 B2
(45) Date of Patent: May 13, 2008

(54) VEHICLE HEADLAMP

(75) Inventor: Hirohiko Ohshio, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/513,670

(22) Filed: Aug. 30, 2006

(65) Prior Publication Data

US 2007/0069580 A1 Mar. 29, 2007

(30) Foreign Application Priority Data

Sep. 9, 2005 (JP) ..... 2005-262714

(51) Int. Cl.
*F21W 101/10* (2006.01)

(52) U.S. Cl. ..... 362/539; 362/512; 362/513; 362/517; 362/538; 362/284

(58) Field of Classification Search ..... 362/512, 362/513, 517, 518, 538, 539, 284, 352
See application file for complete search history.

(56) References Cited

U.S. PATENT DOCUMENTS

2003/0086277 A1* 5/2003 Hayakawa et al. ..... 362/513
2003/0090906 A1* 5/2003 Hayakawa ..... 362/517

FOREIGN PATENT DOCUMENTS

JP 2003-257218 9/2003

* cited by examiner

*Primary Examiner*—Laura Tso
(74) *Attorney, Agent, or Firm*—Fish & Richardson P.C.

(57) ABSTRACT

A vehicle headlamp is provided with: a projector lens; a light source bulb; a reflector for reflecting direct light from the light source bulb to the front side; a movable shade; and an actuator for moving the movable shade between a shading position and a shading relieving position. The movable shade is pivotally arranged so that it can be rotated round a rotary axis extending in a vehicle width direction, in a neighborhood of a lens center axis. A rod member has one end portion connected to the movable shade and the other end portion connected to the actuator. The actuator gives a drive force to the rod member in a longitudinal direction of the rod member.

7 Claims, 9 Drawing Sheets

VEHICLE HEADLAMP

This application claims foreign priority from Japanese Patent Application No. 2005-262714, filed Sep. 9, 2005, the entire contents of which are hereby incorporated by reference.

BACKGROUND OF THE INVENTION

1. <Field of the Invention>

The present invention relates to a vehicle headlamp. More particularly, the present invention relates to a projector type vehicle headlamp having a variable light distributing function capable of changing a light distribution of the headlamp according to a running state of a vehicle.

2. <Related Art>

There is a conventional vehicle headlamp which has a projector type lighting device unit composed in such a manner that light (light source light) emitted from a light source bulb arranged on an optical axis extending in the longitudinal direction of a vehicle is reflected to the front side by a reflector while the light is being converged toward the optical axis and the thus reflected light is irradiated onto the front side of a lighting device through a projection lens provided in the front of the reflector.

This projector type lighting device unit is usually composed as follows. Between the projection lens and the reflector, a shade is arranged which is capable of shading a part of the reflected light sent from the reflector so that an unnecessary part of the reflected light can be shaded by the shade according to a light distribution characteristic such as a low beam light distribution pattern (a passing beam light distribution pattern), that is, it is common that a cut-off line is formed in an upper end portion of a desired light distribution pattern in this way.

In this case, the shade is stationary. Therefore, for example, when the shade is set for the low beam light distribution pattern, this lighting device unit can be only exclusively used for the low beam. It is impossible to change over the lighting device unit to the use for an upper beam (a driving beam).

In order to solve the above problems, a headlight for vehicle use is proposed which is capable of obtaining the most appropriate light distribution characteristic for both the low beam and the upper beam as follows. The shade is a movable shade capable of moving between a low beam position and an upper beam position. In the case of the low beam position, an upper end edge of the shade is positioned at a focus of the projection lens. In the case of the upper beam position, the upper end edge of the shade is positioned at a position which is appropriately displaced from the focus of the projection lens. Due to the foregoing, it is possible to obtain the most appropriate light distribution characteristic which can be used for both the low beam and the upper beam. (Concerning this technique, for example, refer to JP-A-2003-257218.)

However, the movable shade described in JP-A-2003-257218 is pivotally provided so that it can be rotated round a rotary axis extending in the vehicle width direction. This rotary axis is located at a lower end portion of the movable shade, that is, this rotary axis is located at a position distant from the center of gravity of the movable shade. Accordingly, when the vehicle is vibrated, an upper end edge of the movable shade tends to be displaced. Therefore, a position of the cut-off line of the low beam light distribution pattern is likely to change.

In order to suppress the generation of such a displacement of the cut-off line of the low beam light distribution pattern, a return spring is built in an actuator for rotating the movable shade. By the action of this return spring, the movable shade can be urged toward the shading position at all times.

However, in order to effectively suppress the generation of this displacement, it is necessary to set the spring constant of the return spring at a considerably high value. Therefore, a drive force of the actuator, which is necessary for rotating the movable shade, is increased to a considerably high value. Accordingly, it is impossible to reduce the size and weight of the actuator, that is, it is impossible to decrease the manufacturing cost of the actuator.

In the projector type lighting device unit, since being restricted by its structure, an image of the light source composing the light distribution pattern is larger than an image of the parabola type lighting device unit. Therefore, in the case where a beam is changed over by the movable shade, especially in the case of irradiating the upper beam, a luminous intensity can not be raised sufficiently high.

Accordingly, an object of the present invention relates to solve the above problems.

SUMMARY OF THE INVENTION

One or more embodiments of the present invention provide a vehicle headlight, the size and weight of the actuator of which can be reduced without affecting a formation of the low beam light distribution pattern, and the luminous intensity of which can be effectively enhanced at the time of irradiation of light.

In accordance with one or more embodiments of the present invention, a vehicle headlamp is provided with: a projection lens arranged in a lighting chamber, which is formed out of a lamp body and a cover, on a lens center axis extending in the longitudinal direction of a vehicle; a light source bulb arranged at the rear of a rear side focus of the projection lens; a reflector for reflecting direct light, which is directly sent from the light source bulb, to the front side while the reflected light is being converged upon the lens center axis; a movable shade, which is arranged between the projector lens and the light source bulb, for shading a part of the reflected light sent from the reflector and for shading a part of the light directly sent from the light source bulb so as to form a cut-off line of a light distribution pattern; and an actuator for moving the movable shade between a shading position, at which an upper end edge of the movable shade is located close to a rear side focus of the projection lens, and a shading relieving position, at which an amount of shading of the reflected light sent from the reflector is reduced as compared with the shading position, wherein the movable shade is pivotally arranged so that it can be rotated round a rotary axis extending in the vehicle width direction at a position close to the lens center axis, and the actuator gives a drive force to the other end portion of a rod member, one end portion of which is connected to the movable shade, in the longitudinal direction.

In this connection, "a rod member" described above means a substantially linear long member. For example, a wire rod or a plate, the cross section of which is circular or rectangular, can be used as the rod member.

According to the vehicle headlamp of the above structure, since the movable shade is pivotally provided so that it can be rotated round the rotary axis extending in the vehicle width direction in the neighborhood of the lens center axis, it is possible to downsize the movable shade and keep the inertial angular moment at a minimum.

Therefore, even when the spring constant of the return spring is not so high, which is unlike the conventional structure, it is possible to effectively prevent the occurrence of such a problem that an upper end edge of the movable shade is displaced because of the vibration of a vehicle and that a position of the cut-off line of the light distribution pattern is changed. Due to the foregoing, a drive force of the actuator necessary for rotating the movable shade can be reduced. Accordingly, the size and weight of the actuator can be reduced and further the manufacturing cost can be decreased.

Since the movable shade is rotated by the actuator when the rod member is given a drive force in the longitudinal direction, the rod member is seldom bent, and an action of the actuator can be directly transmitted to the movable shade.

Accordingly, the response property of the movable shade operated by the actuator can be enhanced. Further, the drive force can be positively transmitted. Therefore, the reliability of operation of the movable shade can be enhanced. Since the drive force is given to the rod member in the longitudinal direction, it is unnecessary to increase the flexural rigidity of the rod member so high. Accordingly, the rod member can be downsized and the weight can be decreased.

Further, in the vehicle headlamp, a first additional reflector may be is arranged between the reflector and the projector lens for reflecting a part of the direct light, which is directly sent from the light source bulb, to a lower portion of the lens center axis; and a second additional reflector may be arranged in a lower portion of the lens center axis, for reflecting a part of the light which is directly sent from the light source bulb and for reflecting the reflected light sent from the first additional reflector.

According to the above structure, the direct light directly sent from the light source bulb in an oblique upper direction or to the movable shade is reflected by the first additional reflector toward the second additional reflector. Therefore, the direct light directly sent from the light source bulb in an oblique upper direction or to the movable shade is utilized for irradiating the front via the second additional reflector together with a part of the light which is directly sent from the light source bulb. Since the movable shade can be driven by the actuator, which is arranged in a lower part of the second additional reflector, via the rod member, there is no possibility that the light reflected by the second additional reflector is shaded by the actuator.

In general, in the projector type vehicle headlamp, the direct light directly sent from the light source bulb in an oblique upper direction or to the movable shade can not be used for the formation of a light distribution pattern. However, according to the present invention, this direct light directly sent from the light source is reflected downward by the first additional reflector. Then, the reflected light is further reflected by the reflector together with the direct light directly sent from the light source bulb as a light distribution pattern irradiated to the front by the second additional reflector. That is, except for the basic light distribution pattern formed by the light which is reflected by the reflector and transmitted through the projection lens, it is possible to add a light distribution pattern (an addition light distribution pattern) formed by the reflected light sent from the second additional reflector.

Accordingly, while the actuator for driving the movable shade is being provided, the direct light directly sent from the light source bulb in an oblique upper direction or to the movable shade can be utilized for irradiating the front and a part of the direct light directly sent form the light source bulb can be also utilized for irradiating the front. Therefore, the luminous flux utilizing efficiency can be enhanced. Accordingly, it is possible to obtain a brighter light distribution pattern without increasing electric power consumption.

In the vehicle headlamp composed as described, it is preferable that the rod member is arranged on the substantially same plane as that of a support member of supporting an outside electrode of the light source bulb.

In general, the direct light, which is emergent from the lower side of the light source bulb in which a support member of supporting an outside electrode is attached being located at a lower position, is irradiated to the front by the second additional reflector being kicked by this support member. However, according to the structure of the invention, since the rod member is arranged on the substantially same plane as that of this support member, the reflected light reflected by the second additional reflector substantially coincides with a position where the kick is conducted by the rod member. Due to the foregoing, an amount of light kicked by the support member of the outside electrode and the rod member can be minimized.

Further, in the vehicle headlamp, an output shaft of the actuator may be connected to the other end portion of the rod member via a operating direction conversion mechanism, and the output shaft may be driven in the longitudinal direction of a vehicle.

In general, an actuator is driven in such a manner that the output shaft is linearly reciprocated. Therefore, a size of the actuator is increased in the driving direction of the output shaft. However, in the structure of the invention, the actuator can be arranged in the longitudinal direction of a vehicle. Therefore, the lighting device unit can be made compact.

Further, in the vehicle headlamp, the movable shade may be urged toward one of the shading position and the shading relieving position, and the actuator gives a drive force to the rod member in a tensile direction.

According to this structure, when the actuator is driven, the rod member is given only a tensile force. Since the rigidity of the long rod member is relatively high for the tensile force, the long rod member is seldom deflected or bent when the actuator is given only the tensile force. Accordingly, the rod member can be further downsized and the weight can be reduced.

As explained above, according to the vehicle headlamp of the embodiments of the present invention, it is possible to keep the inertial angular moment at a minimum by downsizing the movable shade. Accordingly, it is possible to effectively prevent the occurrence of such a problem that an upper end edge of the movable shade is displaced by the vibration of a vehicle and a position of the cut-off line of the light distribution pattern is changed like the conventional structure. Due to the foregoing, a drive force of the actuator necessary for rotating the movable shade can be reduced. Accordingly, the actuator can be downsized and the weight can be decreased. As a result, the manufacturing cost can be reduced.

Since the rod member connected to the actuator is seldom bent and an action of the actuator can be directly transmitted to the movable shade, the response property of the movable shade by the actuator can be enhanced. At the same time, the drive force can be positively transmitted to the movable shade. Therefore, the reliability of operation of the movable shade is enhanced. Further, it is not necessary that the flexural rigidity of the rod member is unnecessarily increased high. Therefore, the size and weight can be reduced.

Further, the light distribution pattern is formed as follows. After the direct light directly sent from the light source bulb has been reflected downward by the first additional reflector, the reflected light is irradiated to the front by the second additional reflector together with a part of the light directly sent from the light source bulb. Except for the basic light distribution pattern formed by the light reflected by the reflector and transmitted through the projection lens, the light distribution pattern (the addition light distribution pattern), which is formed by the reflected light reflected by the second additional reflector, is added. Due to the foregoing, although the actuator for driving the movable shade is being provided, the direct light sent from the light source bulb in an oblique upper direction or to the movable shade and a part of the light directly sent from the light source bulb are utilized for irradiating the front side. In this way, the light utilizing efficiency can be enhanced. Accordingly, it is possible to obtain a brighter light distribution pattern without increasing the electric power consumption.

Accordingly, the embodiments of the present invention can provide a projector type vehicle headlamp having a movable shade characterized in that: an actuator can be downsized and the weight can be reduced without affecting the formation of a low beam light distribution pattern; and a luminous intensity of the headlamp can be efficiently enhanced at the time of irradiation.

Other aspects and advantages of the invention will be apparent from the following description and the appended claims.

BRIEF DESCRIPTION OF THE DRAWINGS

FIG. 9(*b*) is a perspective view showing an upper beam light distribution pattern formed on a virtual perpendicular screen, which is arranged forward at a position distant from a lighting device by 25 m, by light irradiated forward by a lighting device unit of the vehicle headlamp shown in FIG. 1.

DETAILED DESCRIPTION OF THE EXEMPLARY EMBODIMENTS

Exemplary Embodiments of the invention will be described with reference to the accompanying drawings.

Figure 1:
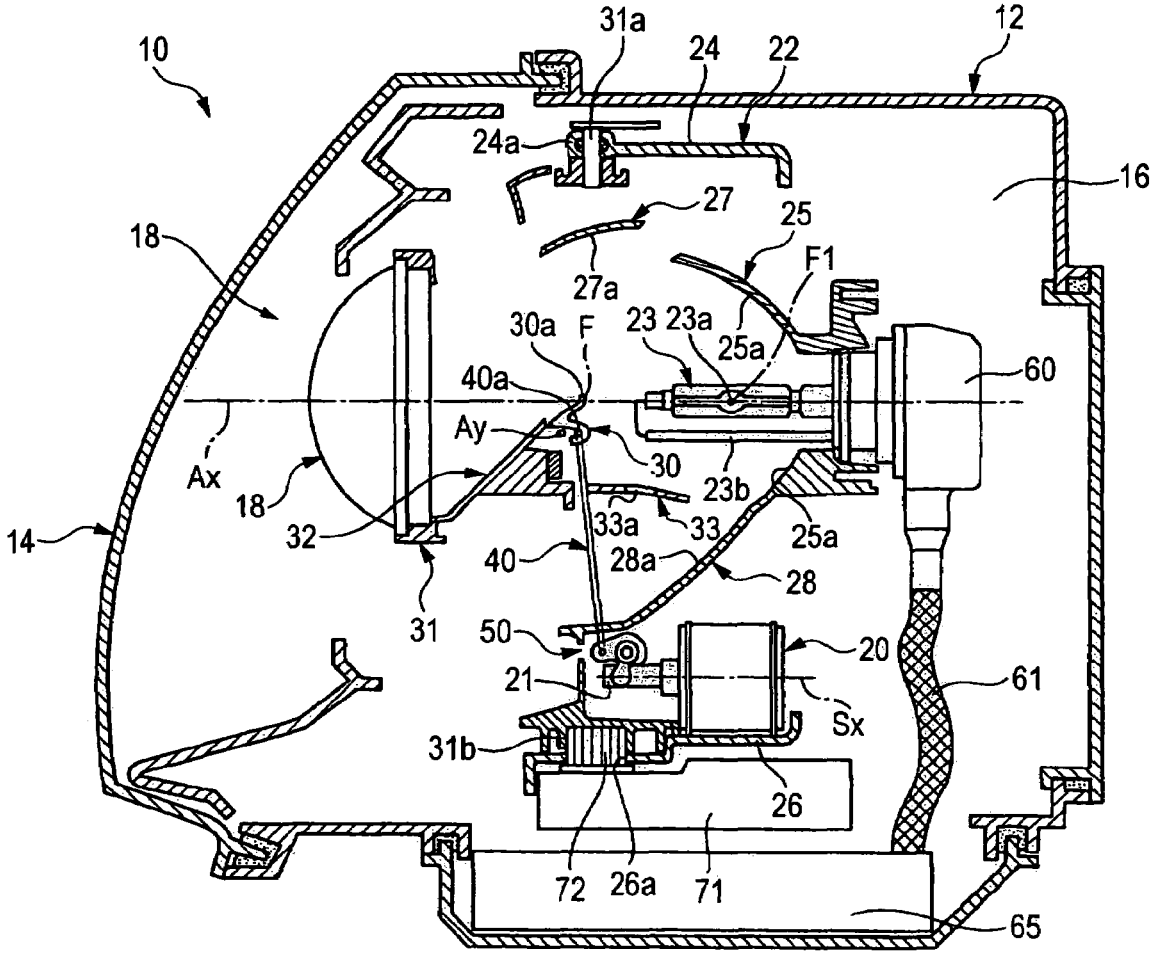
FIG. 1 is a longitudinal sectional view showing an outline of a vehicle headlamp of an exemplary embodiment of the present invention.

FIG. 1 is a longitudinal sectional view showing an outline of a vehicle headlamp of an exemplary embodiment of the present invention.

As shown in FIG. 1, in the vehicle headlamp 10 of this exemplary embodiment, a lighting device unit 18 is accommodated in a lighting chamber 16 formed out of a lamp body 12 and a transparent cover 14 attached to a front opening portion of the lamp body 12.

As shown in FIG. 1, the lighting device unit 18is supported by the lamp body 12 via a frame 22. The frame 22 is supported by the lamp body 12 via an aiming mechanism not shown. The aiming mechanism minutely adjusts an attaching position and an attaching angle of the lighting device unit 18. At a stage in which an aiming adjustment has been completed, the lens center axis $A_x$ of the lighting device unit 18 extends in a direction downward by an angle of 0.5° to 0.6° with respect to the longitudinal direction of a vehicle.

When the frame 22 is viewed from the front, it is formed into a substantially rectangular frame. From an upper and a lower portion of the frame 22, support plates 24, 26 are respectively protruded to the front side. In a front end portion of the upper support plate 24, a bearing portion 24*a* is provided, and a supported shaft 31*a*, which is provided in an upper portion of the lighting device unit 18, is pivotally supported by the bearing portion 24*a*. On the lower side support plate 26, a circular shaft insertion hole 26*a* is formed in a front end portion of the support plate 26 right under the bearing portion 24*a* described above. On a lower face of the lower support plate 26 of the frame 22, a swivel actuator 71 for rotating the lighting device unit 18 in the horizontal direction is fixed.

When the swivel actuator 71 is driven, for example, corresponding to the steering operation, an output shaft 72 is rotated. The output shaft 72 is inserted into a shaft insertion hole 26*a* on the support plate 26 and engaged with a connecting shaft 31*b* provided in a lower portion of the lighting device unit 18, that is, the connecting shaft 31*b* is connected to the output shaft 72.

Accordingly, when the swivel actuator 71 is driven, the output shaft 72 is rotated. According to the rotation of the output shaft 72, the lighting device unit 18 is rotated in the horizontal direction.

Figure 2:
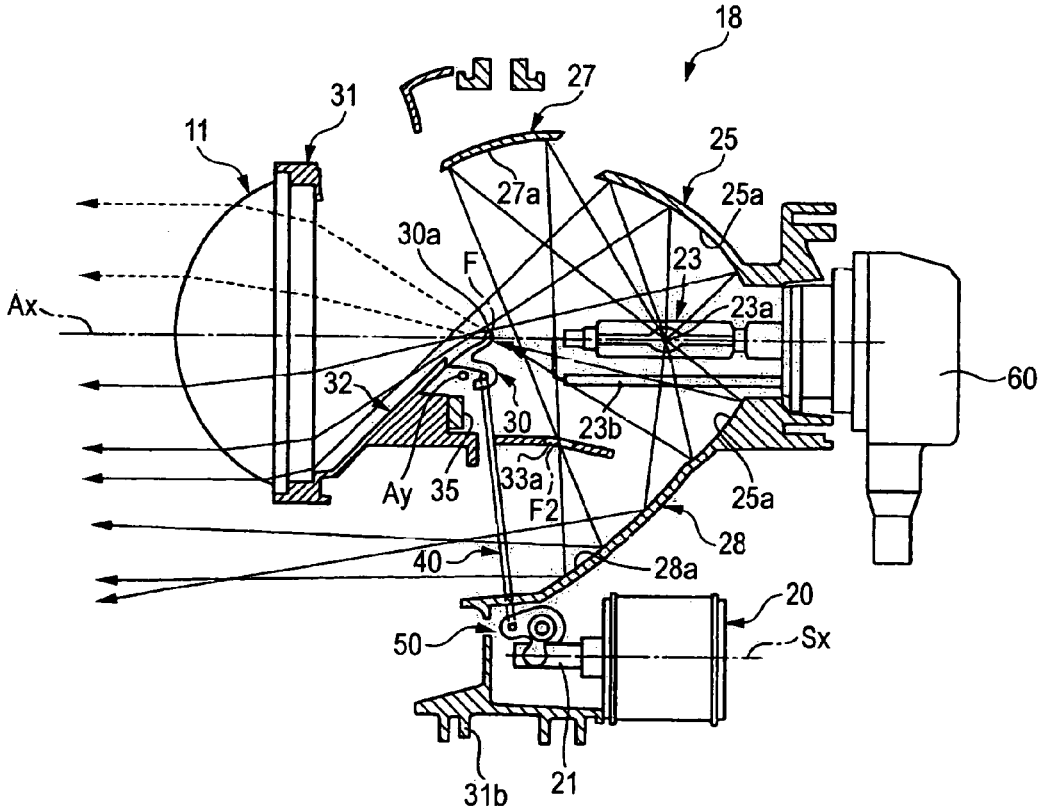
FIG. 2 is a view for explaining operation of a lighting device unit of the vehicle headlamp shown in FIG. 1 in the case where a movable shade is located at a shading position.

As shown in FIGS. 1 and 2, the lighting device unit 18 is a projector type lighting device unit. This lighting device unit 18 includes: a projection lens 11 arranged on the lens center axis $A_x$ extending in the longitudinal direction of a vehicle; a light source bulb 23 arranged at the rear of the rear side focus F of the projection lens 11; a reflector 25 for reflecting light, which has been emitted to the front side by the light source bulb 23, being converged to the lens center axis $A_x$ while the light source 23*a* of the light source bulb 23 is being used as the first focus of the reflector 25; a movable shade 30 arranged in the neighborhood of the rear side focus F so that an upper end edge 30*a* of the movable shade 30 can be located in the neighborhood of the lens center axis $A_x$, wherein the movable shade 30 forms a cut-off line of a light distribution pattern by shading a part of the reflected light sent from the reflector 25 and by shading a part of the light directly sent from the light source bulb 23; a substantially cylindrical holder 31, which is interposed between the projection lens 11 and a front end edge of the reflector 25, for connecting the projection lens 11 with the front end edge of the reflector 25; a stationary shade 32 arranged in an internal space of the holder 31; a rod member 40; an actuator 20; a first additional reflector 27, which is arranged in an upper portion between the reflector 25 and the projection lens 11, for reflecting a part of the direct light directly sent from the light source bulb 23 to a lower side of the lens center axis $A_x$; and a second additional reflector 28, which is arranged in a lower portion of the lens center axis $A_x$, for reflecting the reflected light, which is sent from the first additional reflector 27, to the front side.

The projection lens 11 is a plano-convex lens, the front side surface of which is a convex and the rear side surface of which is a plane. An image on the focal surface including the rear side focus F is projected to the front side as a reverse image.

The light source bulb 23 is a discharge bulb such as a metal halide bulb, the light source of which is a discharge light emitting portion 23*a*. In this exemplary embodiment, while the bulb axis is made to agree with the lens center axis $A_x$, the light source bulb 23 is inserted into and fixed to a rear end portion of the reflector 25.

The light source bulb 23 is attached with a bulb socket 60. A feeder cord 61, which is led out from the bulb socket 60, passes through the back of the lighting device unit 18 and extends downward. Then, the feeder cord 61 is connected to a lighting circuit unit 65 arranged in a lower portion of the lamp body 12. Due to this structure, a lighting voltage and a starting voltage can be supplied from a discharge lighting circuit, which is provided in the lighting circuit unit 65, to the light source bulb 23.

In this connection, it is possible to use a halogen bulb instead of the discharge bulb. The light source bulb 23 can be inserted and fixed from the side of the reflector 25 while the bulb axis is being kept in a direction substantially perpendicular to the lens center $A_x$.

In this case, the concept of "the bulb axis is being kept in a direction substantially perpendicular to the lens center $A_x$", of course, includes a case in which the optical axis of the light source bulb 23 is arranged being perpendicular to the lens center axis $A_x$ extending in the longitudinal direction of the vehicle. The concept also includes a case in which the optical axis of the light source bulb 23 is arranged three-dimensionally crossing the lens center axis $A_x$. The concept also includes a case in which the optical axis of the light source bulb 23 is arranged being inclined with respect to the horizontal line in the vehicle width direction by an angle of ±15°.

The reflector 25 has a reflecting face 25*a* which is formed into a substantial ellipsoid, the center axis of which is the lens center axis $A_x$ passing through the discharge light emitting portion 23*a*.

This reflecting face 25*a* is a substantial ellipsoid, the first focus of which is a center position of the discharge light emitting portion 23*a* of the cross sectional shape containing the lens center axis $A_x$, and the second focus of which is a neighborhood of the rear side focus F of the projection lens 11. Therefore, light emitted by the light emitting portion 10*a* is condensed and reflected to the front side being converged onto the center axis $A_x$. The eccentricity of this reflecting face 25*a* is set so that the eccentricity can be gradually increased when it comes from the perpendicular cross section to the horizontal cross section.

The first additional reflector 27 of this exemplary embodiment is integrally formed at an front end upper portion of the reflector 25. The first additional reflector 27 has a reflecting face 27*a* for reflecting apart of the direct light, which is directly sent from the light source bulb 23, to a lower portion of the lens center axis $A_x$. This reflecting face 27*a* is a substantial ellipsoid, the first focus of which is a center position of the discharge light emitting portion 23*a*, and the second focus F2 of which is a lower portion of the lens center axis $A_x$ of the projection lens 11. Therefore, the light reflected on the reflecting face 27*a* is converged upon the second focus F2.

In this connection, this second focus F2 is set on the face or in the neighborhood of the shade 33 provided in the lower wall rear portion of the holder 31. In the shade 33, a through-hole 33*a* is formed. Therefore, the light condensed at the second focus F2 passes through the through-hole 33*a* and reaches the second additional reflector 28. Accordingly, the light is formed by a hole shape of the through-hole 33. The thus formed light can be used as a mock light source.

The second additional reflector 28 of this exemplary embodiment is integrally formed in a lower portion of the reflector 25 which is arranged under the lens center axis $A_x$. The second additional reflector 28 has a reflecting face 28*a* for reflecting a part of the direct light which is directly sent from the light source bulb 23 and for reflecting the reflected light reflected by the first additional reflector 27. This reflecting face 28*a* is formed out of a substantial paraboloid of revolution having a center axis parallel with the lens center axis $A_x$ and also having a focus at the position of the second focus F2 of the first additional reflector 27. The reflected light sent from the first additional reflector 27 is reflected on the reflected face 28*a* so that it can be formed into parallel light irradiated to the front side.

Figure 4:
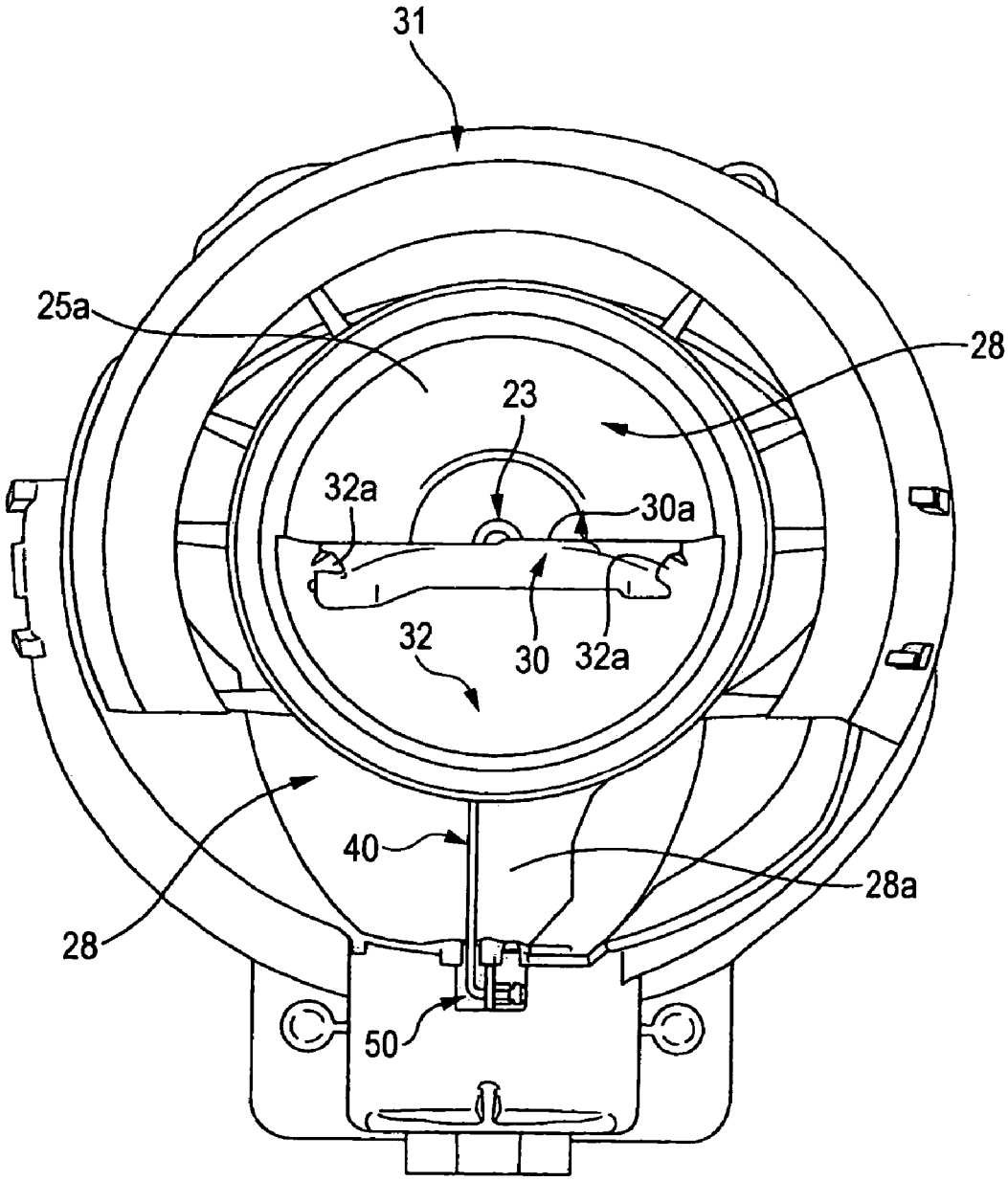
FIG. 4 is a front view showing the lighting device unit shown in FIG. 2.
Figure 5:
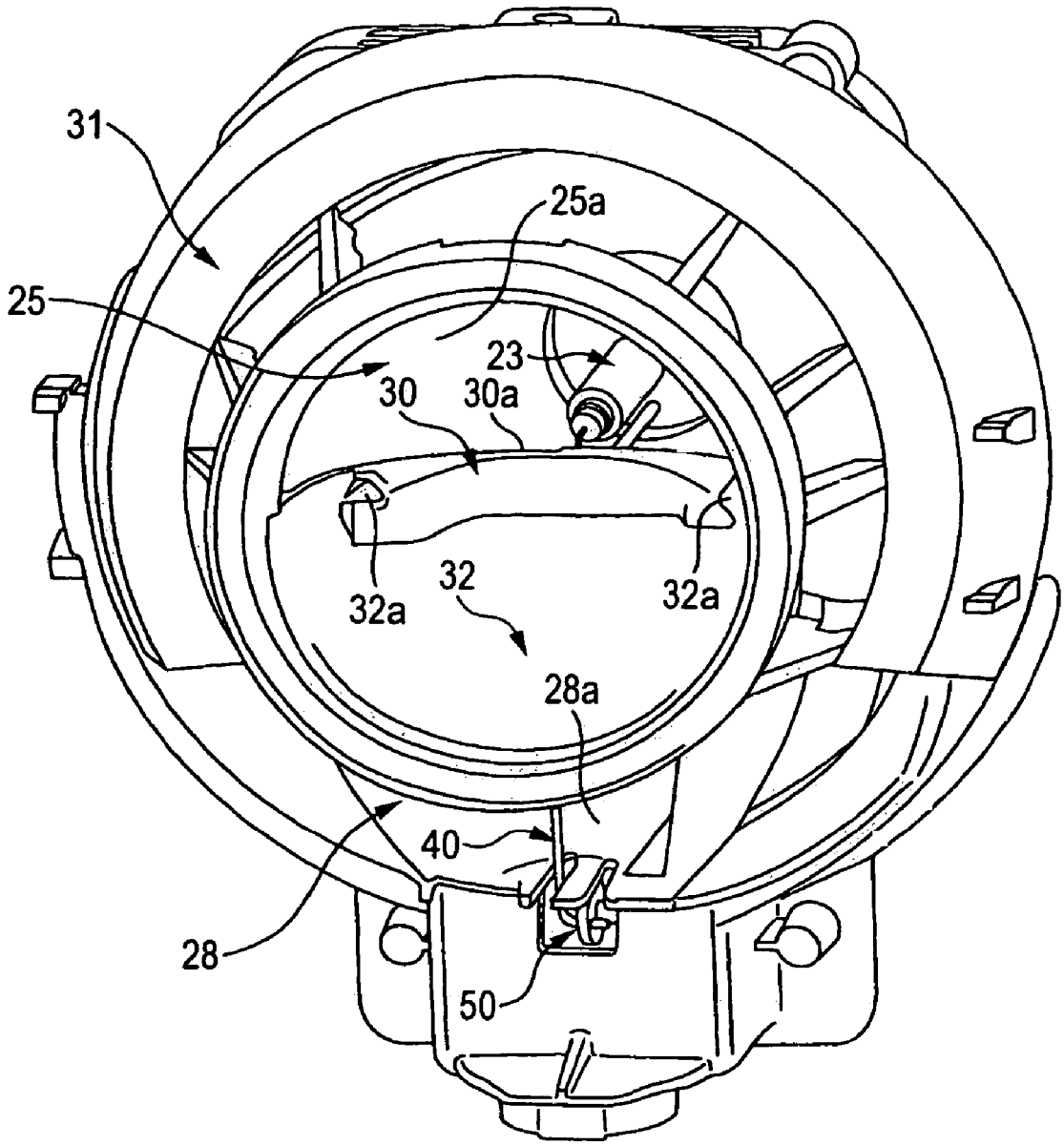
FIG. 5 is a front perspective view showing the lighting device unit shown in FIG. 4.

As shown in FIGS. 4 and 5, the holder 31 includes: a semicircular rear end portion fixed and supported by the front end opening portion of the reflector 25; an annular front end portion for fixing and supporting the projection lens 11; and a plurality of connection ribs for connecting them.

The stationary shade 32 is a shade for preventing stray light, which is reflected by the reflector 25, from being incident upon the projection lens 11. The stationary shade 32 is formed integrally with the holder 31.

Figure 6:
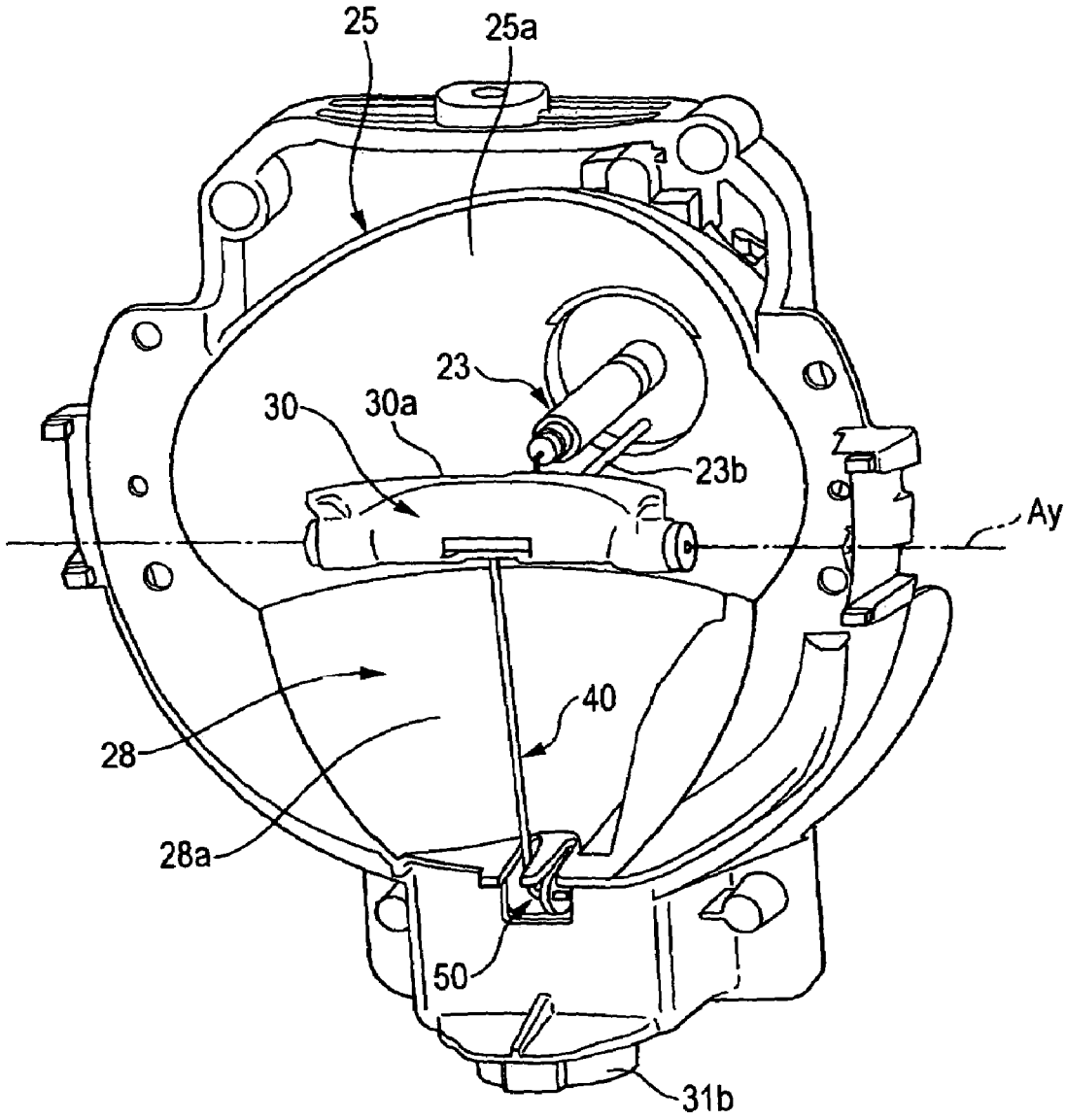
FIG. 6 is a front perspective view showing a state in which a holder is removed from the lighting device unit shown in FIG. 5.
Figure 7:
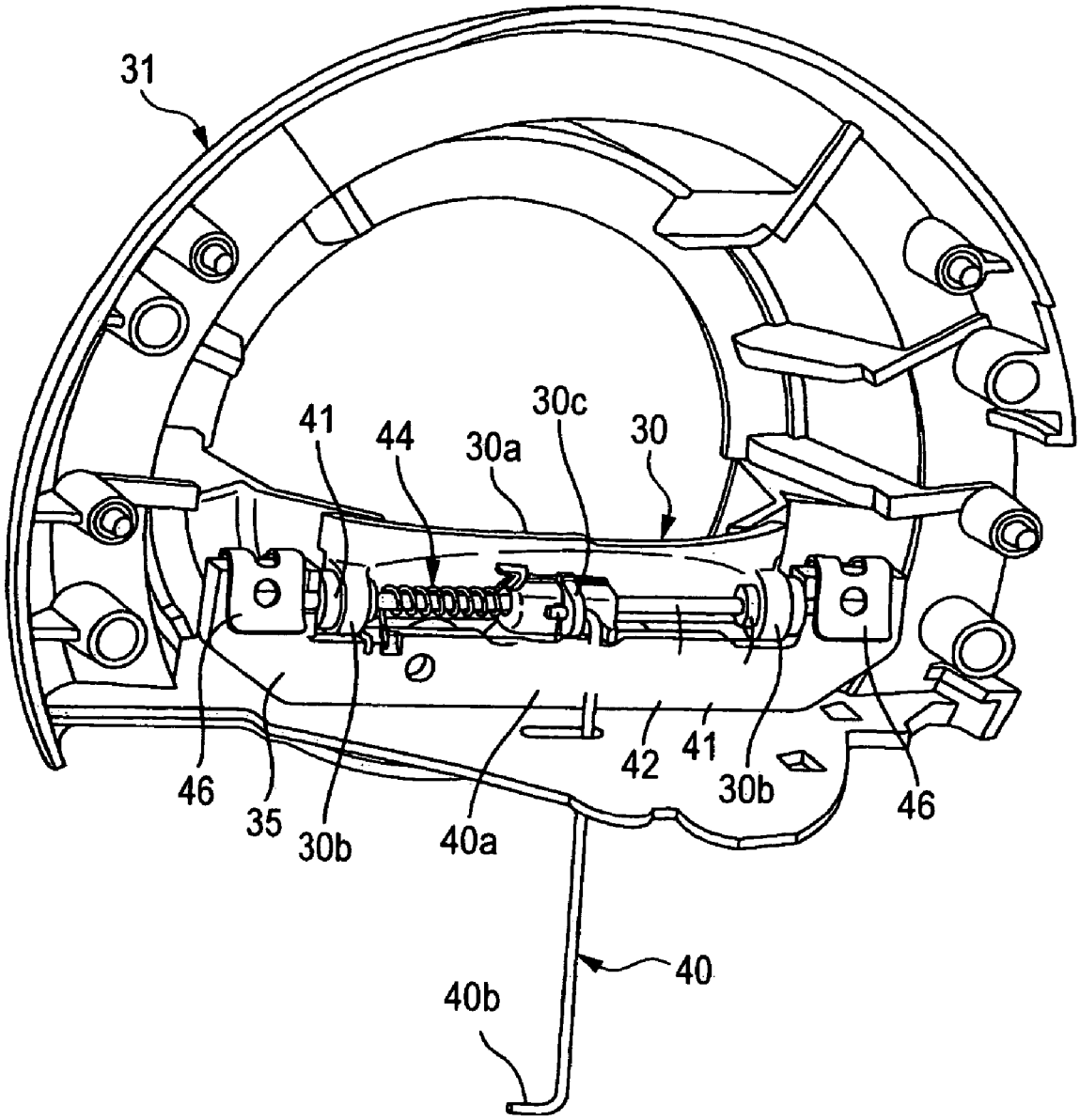
FIG. 7 is a rear perspective view showing a primary portion of the lighting device unit shown in FIG. 4.

As shown in FIGS. 6 and 7, the movable shade 30 is a casting made by means of die-casting. The movable shade 30 is arranged at a position in the neighborhood under the lens center axis $A_x$ in the internal space of the holder 31. The movable shade 30 is pivotally supported so that it can be rotated round the rotary axis $A_y$, which extends in the vehicle width direction, with respect to the holder 31. It is possible for the movable shade 30 to take two positions. One is a shading position shown in FIG. 2 and the other is a shading relieving position shown in FIG. 3 which is a position obtained when the movable shade 30 is rotated by a predetermined angle from this shading position to the rear side. An upper end edge 30*a* of this movable shade 30 is formed in such a manner that the height of the right portion is different from the height of the left portion. When the movable shade 30 is located at the shading position, the movable shade 30 extends curving in a substantial arcuate shape in the horizontal direction along the rear side focal face of the projection lens 11.

As shown in FIG. 7, this movable shade 30 is pivotally supported by the bracket 35 as follows. A rotary shaft member 42 made up of a metallic pin of a predetermined length is inserted into the support portions 30*b*, 30*b*, which are provided at both end portions, via the metal bushes 41. Under the above condition, both end portions of the rotary shaft member 42 are attached into a support groove of the bracket 35 and fixed with clips 46. In this way, the movable shade 30 can be pivotally supported by the bracket 35. When the bracket 35 is fixed to a rear face side of the holder 31, the movable shade 30 can be fixed and supported by the holder 31.

A rod engaging portion 30*c*, which is formed in a central portion of the movable shade 30, is connected to one end engaging portion 40*a* of the rod member 40. A return spring 44 is wound round the rotary shaft member 42. This return spring 44 is a torsion coil spring made of metal. One end portion of the return spring 44 is engaged with the movable shade 30, and the other end portion of the return spring 44 is engaged with the bracket 35. Therefore, the return spring 44 elastically pushes the movable shade 30 toward the shading position at all times. In this connection, when the movable shade 30 is moved to the shading position, it comes into contact with the stopper portions 32*a*, 32*a* formed on both sides of the upper end edge of the stationary shade 32, so that the movable shade can be positioned at the shading position.

When the actuator 20, which is connected with the other end engaging portion (the other end) of the rod member 40, is driven, the movable shade 30 can be moved between the shading position and the shading relieving position.

The actuator 20 includes: a coil 20*a* which is a solenoid wound round a plunger 21 arranged so that the plunger 21 functioning as an output shaft can be protruded to the front of a vehicle in a lower portion of the second additional reflector 28; a yoke body 20*b* for covering the coil 20*a*;and a yoke cover 20*c*. The actuator 20 is fixed and supported by the holder 31 via the yoke cover 20*c* which is fixed by screwing to a lower end portion of the holder 31.

This actuator 20 is driven when a beam changeover switch not shown is operated. A linear reciprocating motion of the plunger 21 is transmitted to the rod member 40 via the operating direction conversion mechanism 50. Therefore, the movable shade 30, which is connected to one end engaging portion 40*a* of the rod member 40, is rotated.

Figure 8:
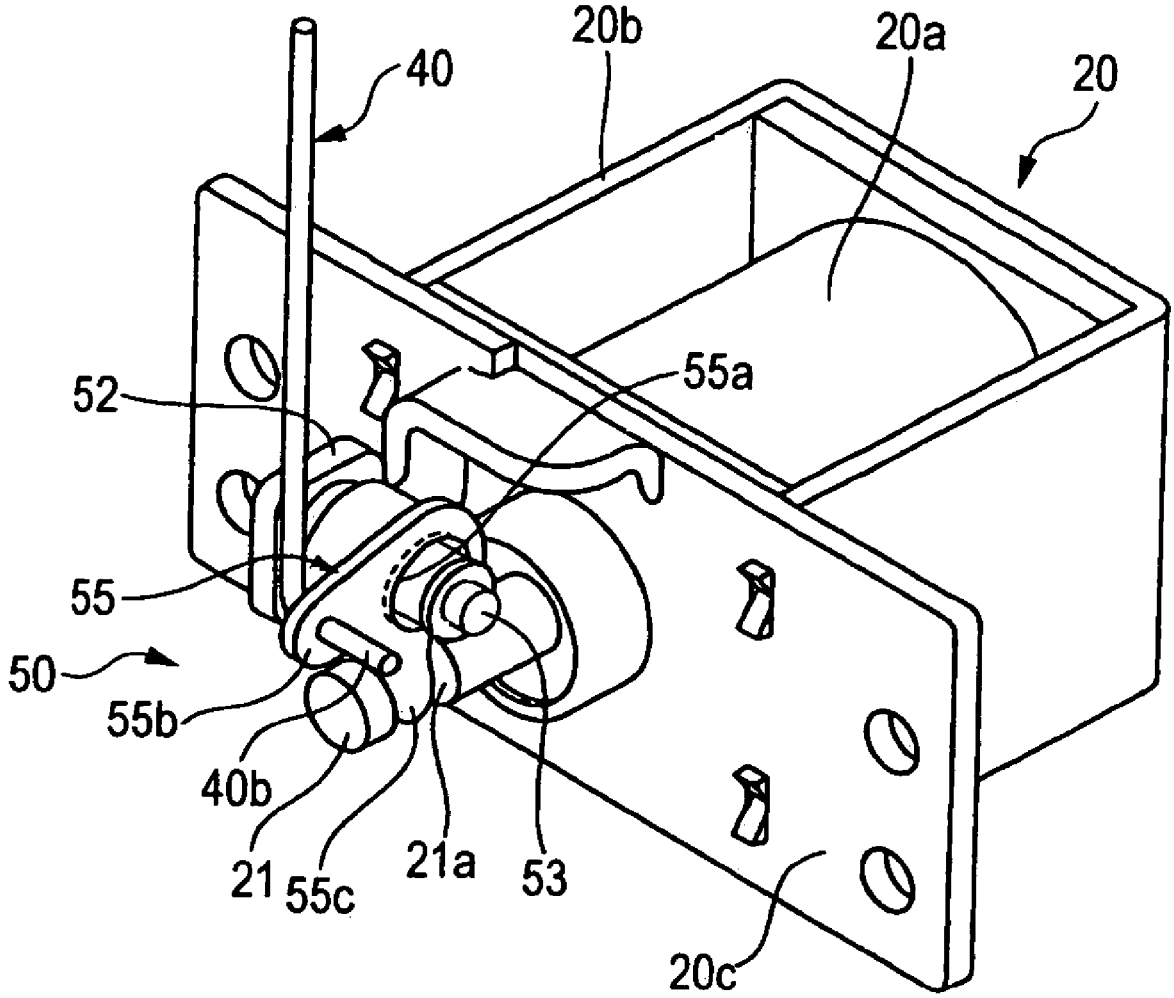
FIG. 8 is an enlarged perspective view showing a primary portion for explaining the operating direction conversion mechanism shown in FIG. 1.

As shown in FIG. 8, the operation direction conversion mechanism 50 includes: a support shaft 53, which is perpendicularly arranged on a support plate portion 52 protruding forward from a front face of a yoke cover 20*c*, crossing a plunger 21 of the actuator 20; a rotary plate 55, which is pivotally supported by the support shaft 53 penetrating a through-hole 55*a*, having a rod engaging portion 55*b* protruding in the radial direction from a rotary center and also having plunger engaging portion 55*c*; and a C-shaped cutout portion 21*a* formed at a forward end portion of the plunger 21.

The plunger engaging portion 55*c* having an arcuate portion, which engages with the cutout portion 21*a*, converts a reciprocating motion of the plunger 21, which is conducted in the longitudinal direction of a vehicle, into a rotary motion of the rotary plate 55 by the contacting action with a front end face and a rear end face of the cutout portion 21*a*. When the rotary plate 55 is rotated round the support shaft 53, the rod member 40, the other end engaging portion 40*b* of which is engaged with the rod engaging portion 55*b*, is reciprocated in the substantially vertical direction.

Accordingly, in the operating direction conversion mechanism 50 of this exemplary embodiment, it is sufficient that the cutout portion 21*a* is formed in the plunger 21 without forming a slit and a through-hole in the plunger. Therefore, the manufacturing cost can be reduced. Further, a reciprocating motion of the plunger 21 conducted in the longitudinal direction of a vehicle can be smoothly converted into a reciprocating motion of the rod member 40 conducted in the substantially vertical direction.

The rod member 40 is composed of a wire member, both end portions 40*a*, 40*b* of which are bent into an L-shape. Therefore, when the rod member 40 is reciprocated in the substantially vertical direction, the movable shade 30, one end engaging portion 40*a* of which is connected to the rod engaging portion 30*c*, is rotated round the rotary shaft member 42, which extends in the vehicle width direction, between the shading position and the shading relieving position.

According to the vehicle headlamp 10 of this exemplary embodiment, in the neighborhood of the lens center axis $A_x$, the movable shade 30 is arranged being capable of rotating round the rotary axis $A_y$ extending in the vehicle width direction. Therefore, the movable shade 30 can be down sized and the inertial rotary moment can be minimized.

Therefore, even when the spring constant of the return spring 44 is not increased, which is not like the conventional structure, it is possible to effectively prevent the occurrence of such a problem that an upper end edge 30*a* of the movable shade 30 is displaced by the vehicle vibration and a position of the cut-off line of the light distribution pattern is changed. Due to the foregoing, without affecting the formation of the low beam light distribution pattern, a drive force of driving the actuator 20, which is necessary for rotating the movable shade 30, can be reduced. In this connection, when setting is conducted so that the rotary axis $A_y$ can pass through the center of gravity of the movable shade 30, a displacement of the movable shade 30 can be minimized. Therefore, the actuator 20 can be downsized and the weight can be reduced.

Since the operating direction changeover mechanism 50 is used, the movable shade 30 is rotated by the actuator 20 when the plunger 21 reciprocating in the longitudinal direction of a vehicle gives a drive force to the rod member 40 in the longitudinal direction of the rod member 40. Therefore, the rod member 40 is seldom bent and an action of the actuator 20 can be directly transmitted to the movable shade 30.

Accordingly, the response property of the movable shade 30 by the actuator 20 can be enhanced. Further, the drive force can be positively transmitted from the actuator 20 to the movable shade 30. Therefore, the operation reliability of the movable shade 30 can be enhanced. Since a drive force is given to the rod member 40 in the longitudinal direction, it is not needed to unnecessarily enhance the flexural rigidity of the rod member 40. Accordingly, the rod member 40 can be downsized and the weight can be reduced.

Next, an optical action of the movable shade 30 will be explained below.

FIG. 2 is a view showing a state in which the movable shade 30 is positioned at the shading position.

In this state in which the movable shade 30 is located at the shading position, the upper end edge 30*a* of the movable shade 30, which forms a cut-off line on the light distribution pattern, is arranged so that it can pass through the rear side focus F of the projection lens 11. Due to this arrangement, a part of the reflected light sent from the reflecting face 25*a* of the reflector 25 is shaded and most of the upward light (shown by the broken line in FIG. 2), which is emergent from the projection lens 11 to the front side, can be removed. Therefore, the low beam light distribution pattern PL, which is used in the case of driving on the left, is formed which has a so-called Z-type cutoff line CL shown in FIG. 9(*a*) in which the height on the right and the height on the left are different from each other.

Figure 3:
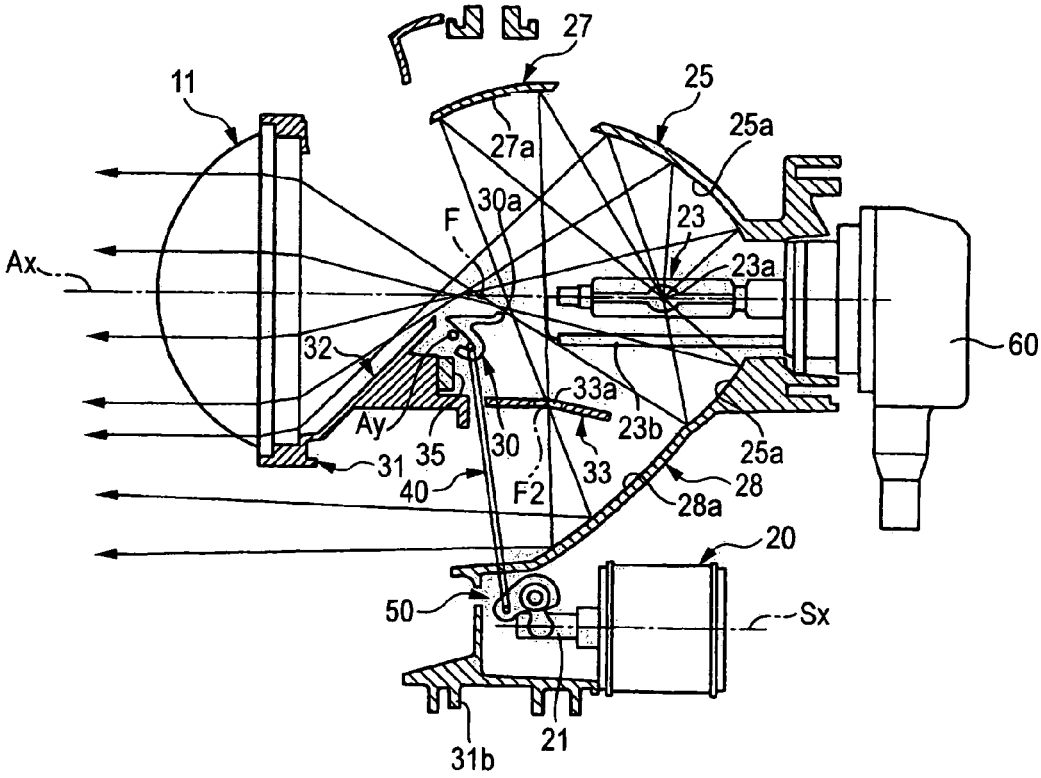
FIG. 3 is a view for explaining operation of alighting device unit of the vehicle headlamp shown in FIG. 1 in the case where a movable shade is located at a shading relieving position.
Figure 9:
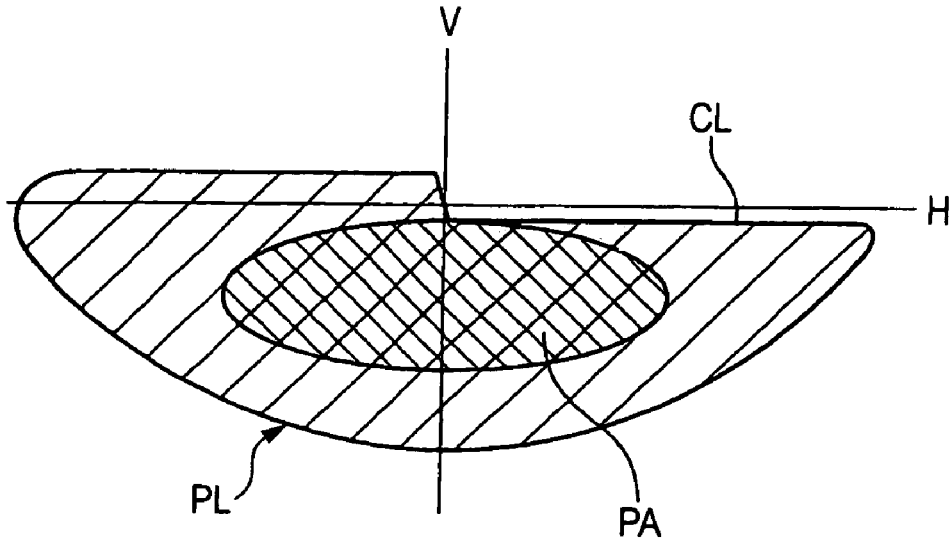
FIG. 9(*a*) is a perspective view showing a low beam light distribution pattern formed on a virtual perpendicular screen, which is arranged forward at a position distant from a lighting device by 25 m, by light irradiated forward by a lighting device unit of the vehicle headlamp shown in FIG. 1.
Figure 9:
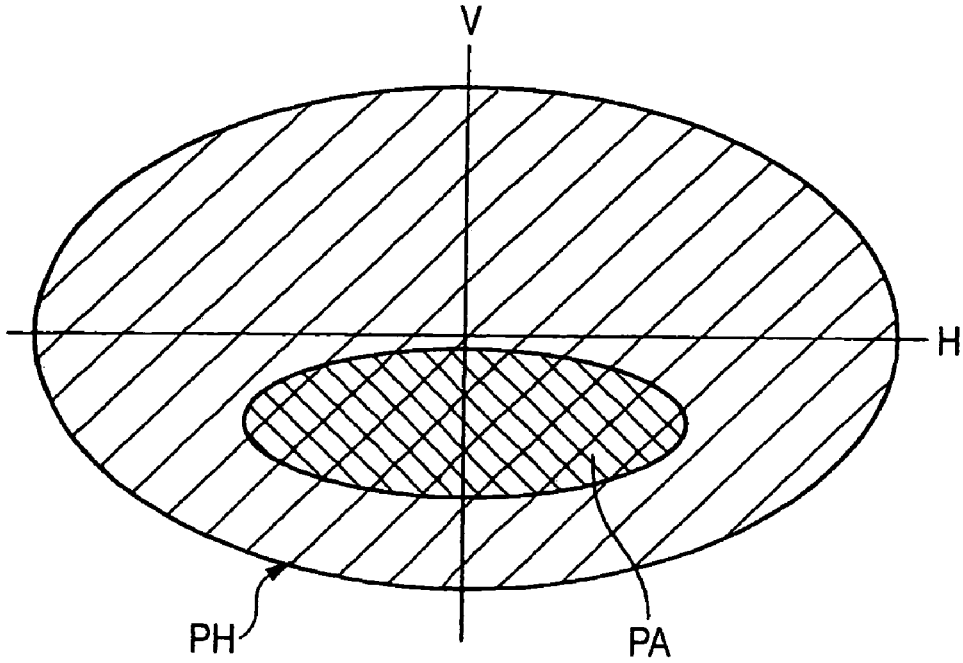

On the other hand, when the movable shade 30 is moved from the shading position to the shading relieving position as shown in FIG. 3, the upper end edge 30*a* of the movable shade 30 is obliquely displaced downward to the rear side. Therefore, an amount of the shaded light with respect to the reflected light, which is sent from the reflecting face 25*a* of the reflector 25, is reduced. In this exemplary embodiment, at this shading relieving position, an amount of the shaded light with respect to the reflected light, which is sent from the reflecting face 25*a*, becomes substantially zero. Therefore, the light distribution pattern PH for the upper beam can be formed as shown in FIG. 9(*b*).

The direct light, which is directly sent from the light source valve 23 obliquely upward irrespective of the position of the movable shade 30, is reflected by the reflecting face 27*a* of the first additional reflector 27 toward the second additional reflector 28 and further reflected by the reflecting face 28*a* of the second additional reflector 28, so that it can be utilized for the front irradiation together with a part of the direct light which is directly sent from the light source bulb 23. Therefore, as shown in FIGS. 9(*a*) and 9(*b*), the addition light distribution pattern PA is overlapped respectively on the region of the light distribution pattern PL for the low beam or the region of the light distribution pattern PH for the upper beam.

In general, in the projector type headlight for vehicle use, the direct light, which is sent from the light source bulb 23 obliquely upward, is not used for the formation of the light distribution pattern. However, in the vehicle headlamp 10 of this exemplary embodiment, this direct light is reflected downward by the first additional reflector 27 and then reflected by the second additional reflector 28 are irradiated to the front side. In this way, the light distribution pattern is formed except for the basic light distribution (the light distribution pattern PL for the low beam or the light distribution pattern PH for the upper beam) which is formed by the light reflected by the reflector 25 and transmitted through the projection lens 11. That is, the light distribution pattern (the addition light distribution pattern PA), which is formed by the reflected light sent from the second additional reflector 28, can be added to the basic light distribution pattern (the light distribution pattern PL for the low beam or the light distribution pattern PH for the upper beam).

The movable shade 30 can be driven by the actuator 20, which is arranged under the second additional reflector 28, via the rod member 40. Therefore, the reflected light sent from the second additional reflector 28 is not shaded by the actuator 20.

Although the vehicle headlamp 10 of this exemplary embodiment is provided with the actuator 20 for driving the movable shade 30, the direct light, which is sent from the light source bulb 23 obliquely upward, can be utilized for the front irradiation and the light flux utilizing efficiency can be enhanced. Therefore, it is possible to obtain a brighter light distribution pattern without increasing the electric power consumption.

Further, in the vehicle headlamp 10 of this exemplary embodiment, the rod member 40 is arranged on the substantially same plane as that of the support member 23*b* of the outside electrode of the light source bulb 23.

That is, as shown in FIG. 1, the light source bulb 23 is attached so that the support member 23*b* of the out side electrode can be positioned downward. As shown in FIG. 4, the rod member 40 is arranged so that it can be substantially perpendicularly extended downward from the light source bulb 23. Therefore, the rod member 40 shades the reflecting face 28*a* of the second additional reflector 28 in the vertical direction when the view is taken from the front side.

Therefore, the direct light, which is emergent from the lower side of the light source bulb 23 attached so that the support member 23*b* of the outer electrode can be positioned downward, is kicked by this support member 23*b* and irradiated to the front side by the second additional reflector 28*a*. However, since the rod member 40 is arranged on the substantially same plane as that of the support member 23*b*, the reflected light of the second additional reflector 28*a* substantially agrees with the position where the light is kicked by the rod member 40.

Accordingly, it is possible to minimize an amount of light kicked by the support member 23*b* of the outside electrode and the rod member 40.

In the vehicle headlamp 10 of this exemplary embodiment, the plunger 21 of the actuator 20 is connected to the other end portion of the rod member 40 via the operating direction conversion mechanism 50 and driven in the longitudinal direction of a vehicle.

Since the actuator 20 is driven while conducting a linear reciprocating motion of the plunger 21, a size of the actuator 20 is increased in the driving direction of the plunger 21. However, the plunger 21 is connected to the other end portion 40*b* of the rod member 40 via the operating direction conversion mechanism 50. Therefore, even when the actuator 20 is driven in the longitudinal direction of a vehicle, the rod member 40 can be driven in the vertical direction.

Therefore, the actuator 20 can be arranged while the drive direction of the actuator 20 is being made to agree with the longitudinal direction of the vehicle. Accordingly, the lighting device unit 18 can be made compact.

In this connection, in the vehicle headlamp of the exemplary embodiment of the present invention, in the case where a sufficiently large space is provided in a lower portion of the lighting device unit 18, of course, the actuator 20 may be arranged while the drive direction of the actuator 20 is being made to agree with the vertical direction of the vehicle and the plunger 21 may be directly connected to the other end portion 40*b* of the rod member 40.

In the vehicle headlamp 10 of this exemplary embodiment, the movable shade 30 is elastically pushed toward the shading position by the return spring 44 at all times, and when the actuator 20 gives a drive force to the rod member 40 in the tensile direction, the movable shade can be rotated.

That is, when the actuator is driven, only a tensile force acts on the rod member 40. Since the rigidity of the long rod member 40 is relatively high with respect to the tensile force and the long rod member 40 is seldom deflected and bent with respect to the tensile force, as compared with a structure in which the rod member 40 is given a compressive force, the size and weight can be reduced.

In this connection, the specific structure of the vehicle headlamp of the present invention is not limited to the structure of the vehicle headlamp 10 of the above exemplary embodiment.

For example, in the exemplary embodiment, the rod member 44 is formed out of a wire member, the cross-section of which is circular. However, as long as it is a linear long member, various type members such as a wire member, the cross-section of which is rectangular, and a plate member can be adopted.

In the above exemplary embodiment, the first additional reflector 27 and the second additional reflector 28 are respectively formed in a front upper portion and a lower portion of the reflector 25 being integrated with the reflector 25 into one body. However, the present invention is not limited to the above specific exemplary embodiment. The first additional reflector 27 and the second additional reflector 28 may be formed separately from the reflector 25.

The above exemplary embodiment is composed in such a manner that the first additional reflector 27 reflects the direct light, which is sent from the light source bulb 23 obliquely upward, toward the second additional reflector 28. However, the following structure may be adopted. For example, the first additional reflector 27 is arranged on the rear side of the stationary shade 32, and the direct light, which is sent from the light source bulb 23 to the stationary shade 32, is reflected toward the second additional reflector 28.

In the above exemplary embodiment, the reflecting face 27*a* of the first additional reflector 27 and the reflecting face 28*a* of the second additional reflector 28 are respectively formed out of a substantially ellipsoidal face and a paraboloid of revolution face. However, the present invention is not limited to the above specific exemplary embodiment. Of course, according to a desired addition light distribution pattern PA, various reflecting face shapes can be adopted.

It will be apparent to those skilled in the art that various modifications and variations can be made to the described embodiments of the present invention without departing from the spirit or scope of the invention. Thus, it is intended that the present invention cover all modifications and variations of this invention consistent with the scope of the appended claims and their equivalents.

What is claimed is:

1. A vehicle headlamp comprising:

a projection lens disposed on a lens center axis extending in a longitudinal direction of a vehicle;

a light source bulb arranged at a rear of a rear side focus of the projection lens;

a reflector that reflects direct light directly sent from the light source bulb to a front side;

a movable shade arranged between the projector lens and the light source bulb and pivotable around a rotary axis extending in a vehicle width direction;

an actuator that actuates the movable shade; and a rod member having one end portion connected to the moveable shade and the other end portion connected to an output shaft of the actuator via an operating direction conversion mechanism, wherein the actuator gives a drive force to the rod member in a longitudinal direction of the rod member and the output shaft is driven in the longitudinal direction of a vehicle.

2. The vehicle headlamp according to claim 1, wherein the reflected light reflected on the reflector is converged upon the lens center axis, the movable shade shades a part of the reflected light sent from the reflector and a part of the direct light directly sent from the light source bulb, and forms a cut-off line of a light distribution pattern, the movable shade is movable between a shading position, at which an upper end edge of the movable shade is located in the vicinity of a rear side focus of the projection lens, and a shading relieving position, at which an amount of shading of the reflected light sent from the reflector is reduced as compared with the shading position, and the rotary axis of the movable shade is disposed at a position in the vicinity of the lens center axis.

3. The vehicle headlamp according to claim 1, further comprising:

a first additional reflector which is arranged between the reflector and the projector lens and reflects a part of the direct light directly sent from the light source bulb to a lower portion of the lens center axis; and a second additional reflector which is arranged in the lower portion of the lens center axis and reflects forward the reflected light sent from the first additional reflector.

4. The vehicle headlamp according to claim 3, wherein the actuator includes an output shaft that is capable of protruding in a direction of the front of the vehicle at a lower portion of the second additional reflector.

5. A vehicle headlamp comprising:

a projection lens disposed on a lens center axis extending in a longitudinal direction of a vehicle;

a light source bulb arranged at a rear of a rear side focus of the projection lens;

a reflector that reflects direct light directly sent from the light source bulb to a front side;

a movable shade arranged between the projector lens and the light source bulb and pivotable around a rotary axis extending in a vehicle width direction;

an actuator that actuates the movable shade; and a rod member having one end portion connected to the moveable shade and the other end portion connected to the actuator, wherein the actuator gives a drive force to the rod member in a longitudinal direction of the rod member and the rod member is arranged on the substantially same plane as that of a support member of supporting an outside electrode of the light source bulb.

6. The vehicle headlamp according to claim 1, wherein the movable shade is urged toward the shading position, and the actuator gives a drive force to the rod member in a tensile direction.

7. The vehicle headlamp according to claim 1, wherein the movable shade is urged toward the shading relieving position, and the actuator gives a drive force to the rod member in a tensile direction.

* * * * *